US006241630B1

(12) United States Patent
Alberti

(10) Patent No.: US 6,241,630 B1
(45) Date of Patent: Jun. 5, 2001

(54) COLLAPSIBLE SPORT POLE

(76) Inventor: Michael A. Alberti, 1030 Elton Dr., Endicott, NY (US) 13760

( * ) Notice: Subject to any disclaimer, the term of this patent is extended or adjusted under 35 U.S.C. 154(b) by 0 days.

(21) Appl. No.: 09/170,452

(22) Filed: Oct. 13, 1998

(51) Int. Cl.[7] ..... A63B 71/00; A63B 61/02; F16C 11/10

(52) U.S. Cl. ..... 473/492; 473/493; 403/102; 403/353

(58) Field of Search ..... 473/492, 493, 473/494, 495, 483, 484, 490, FOR 118, FOR 123, 296, 476; 403/102, 353; 16/331, 319; 248/462, 463, 512, 513, 528, 523

(56) References Cited

U.S. PATENT DOCUMENTS 2,812,945 * 11/1957 Barreca .
2,957,187 * 10/1960 Raia .
3,017,183 * 1/1962 Chalcroft .
3,811,455 * 5/1974 Thur .
4,993,719 * 2/1991 Hernandez .
5,014,983 * 5/1991 Saunders .
5,326,109 * 7/1994 Robl .
5,539,957 * 7/1996 Schmidt .
5,746,533 * 5/1998 Schmidt .

* cited by examiner

*Primary Examiner*—Sebastiano Passaniti
(74) *Attorney, Agent, or Firm*—Taylor & Aust, P.C.

(57) ABSTRACT

A sports pole includes two to four elongated tubular members permanently joined together with a first of the tubular members or poles pivotably joined near one end to a second of the poles. A third of the poles may be telescopically received within or about the first pole and slidingly movable therealong between retracted and extended positions. There is a U-shaped spring and pin arrangement for locking the third tubular member in the extended position. A fourth of the poles may be telescopically received within or about the second pole and be similarly slidingly movable therealong between retracted and extended positions. Again, there is a U-shaped spring and pin arrangement for locking the fourth tubular member in the extended position. The first and second tubular members are pivotably joined by a hinge mechanism which allows selective pivotal motion between generally coaxial and generally parallel positions. A locking arrangement prevents pivotable motion between the first and second members when the first and second members are in the coaxial position. This unique combination of hinging with telescoping allows compacting of the sports pole structure with no disassembly.

16 Claims, 7 Drawing Sheets

30
11
47
45
13
32

49
45
47
13
11
30
32
11
63
11
47
27
45
49
13
43
13
17
42
41
39
15
15
35
31
33

30
11
27
45
13
32
11
45
27
49
13

COLLAPSIBLE SPORT POLE

SUMMARY OF THE INVENTION

The present invention relates generally to sports poles and more especially to a relatively long pole structure which is readily compacted for transportation and storage.

The most common applications for such sports poles are in the fields of volleyball, badminton and tetherball.

There have been numerous attempts to reduce the overall size of such a pole structure to enable it to be transported or stored. Existing designs include telescoping a tubular member within a larger diameter tubular member or simply providing several lengths of same diameter tubes with various means of coupling and uncoupling them from each other. For example, by flaring or necking-down one end of a tubular member, two or more such members may be joined end to end. By employing dissimilar diameter tubular members, they may be separated, reversed, and one nested within the other for transportation or storage. One annoying problem with such an arrangement is when lifting any but the lowermost tubular member, the lower ones frequently separate and fall to the ground. The user must then repeat the assembly process. Shock cording the pole sections together avoids this problem, but the pole sections can no longer be nested. Such shock cord arrangements are undesirable for a number of other reasons.

Among the several objects of the present invention may be noted the provision of a pole structure which both collapses and telescopes; the provision of a collapsible, telescoping pole structure which compacts without disassembly or removing any component part; the provision of a sports pole which folds by means of a lockable hinge mechanism articulating two separate tubular members between collinear and parallel positions with a telescopic member slidingly situated within or about one of the tubular members; and the provision of a lockable hinge for joining tubular members and useful for forming an articulated tubular structure. These as well as other advantageous features of the present invention will be in part apparent and in part pointed out hereinafter.

In general and in one form of the invention, a sports pole is formed of at least two and frequently three elongated hollow tubular members permanently joined together. A first one of the tubular members is pivotably joined near one end to a second one of the tubular members. A third tubular members is telescopically received within or about the first tubular member and slidingly movable therealong between retracted and extended positions. This facilitates erection of relatively high nets such as used in volleyball or other items where the two pivotable members may be pivoted to the extended position and locked. The net or other item is then fastened to the upper end of the second member and thereafter the third member is telescopically extended so the net is located well above the users head. There is an arrangement for locking the third tubular member in the extended position. The first and second tubular members are pivotably joined by a hinge mechanism for selective pivotal motion between collapsed and extended positions, and a cuff or cam arrangement is provided for locking the hinge to prevent pivotable motion between the first and second tubular members when the first and second tubular members are in the extended or coaxial position.

Figure 1:
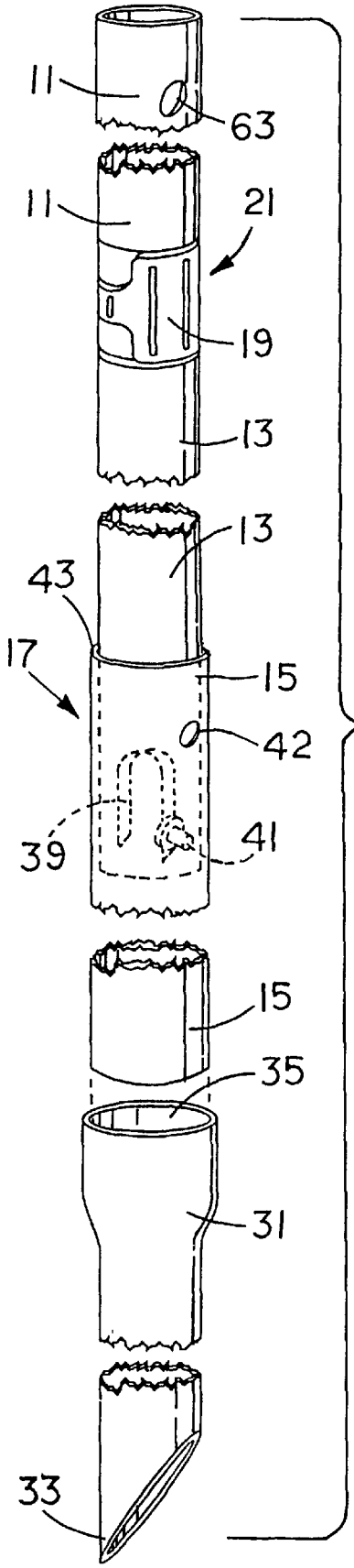
FIG. 1 is a partially exploded perspective view of a preferred embodiment of a sports pole with locked hinge and telescopic member nearly completely extended.

Corresponding reference characters indicate corresponding parts throughout the several views of the drawing. The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

The sports pole comprises at least two elongated tubular members such as 11, 13 and 15 in FIG. 1 which are permanently joined together by screws, solvent bonding or similar technique. A first of the tubular members 13 is pivotably joined near one end to a second of the tubular members 11 and a third of the members 15 is telescopically mated with the first tubular member 13 and slidingly movable therealong between retracted and extended positions. It will be understood that the tubular members 11, 13 and 15 are generally on the order of four inches or less in diameter and two to four feet in length. They are illustrated broken away and relatively foreshortened for convenience.

Figure 2:
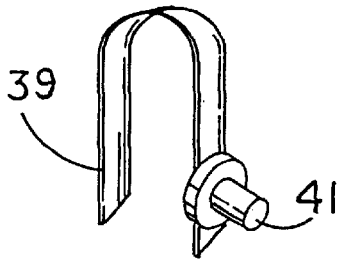
FIG. 2 is a perspective view of the telescopic member locking spring and pin.
Figure 11:
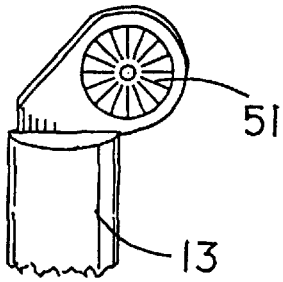
FIG. 11 is a perspective view showing one of the interlockable faces of the hinging mechanism of FIGS. 6–10.
Figure 5:
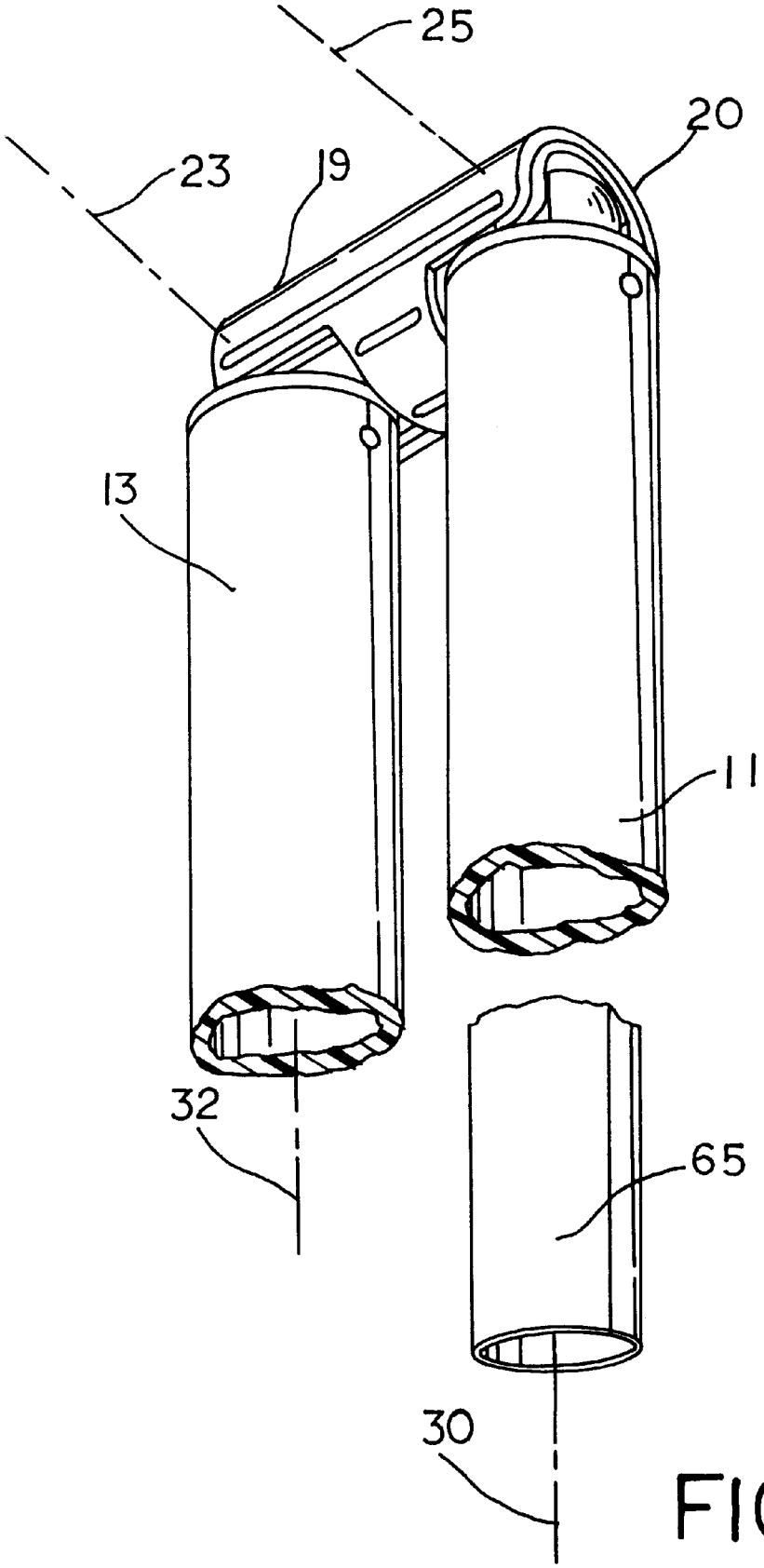
FIG. 5 is a perspective view of the hinge of FIG. 1 unlocked and tubular members folded to parallel position.

The arrangement 17 for locking the third tubular member 15 in the extended position is shown enlarged in FIG. 2. The first 13 and second 11 tubular members are pivotably joined by a hinge mechanism 21 which allows for selective pivotal motion between generally collinear (coaxial) relation as shown in FIGS. 1, 3, 4, 13 and 14 and a generally parallel position as shown in FIG. 5.

The hinging mechanism 21 depicted in the preferred embodiment of FIGS. 1–5, 13 and 14 is more completely described in U.S. Pat. No. 5,746,533. Moreover, the hinging mechanism of U.S. Pat. No. 5,539,957 may be substituted therefor. The sleeve 19 is rotatable about its axis and functions to selectively lock the hinge to prevent pivotable motion between the first 13 and second 11 members when the first and second members are in the collinear position as in FIG. 1. The sleeve or cuff 19 is rotatable through about 180 degrees about the common axes 30 and 32 between the locked (FIG. 4) and freed or unlocked (FIG. 3) positions. The hinge mechanism includes a pair of spaced apart generally parallel pivotal axes 23 and 25 shown in FIGS. 3 and 5. In contradistinction, the sports pole of FIGS. 6–11 has a hinge mechanism with a single pivotal axis 27 which is offset from the common axes 30 and 32 of the tubular members when in the collinear position as shown in FIGS. 6–9.

FIG. 1 includes a hole 63 for receiving the line of a net as discussed later in conjunction with FIG. 14. FIG. 1 also illustrates a further optional tubular member 31 having one end 33 generally pointed to be more easily pushed into the ground and another end 35 flared to receive the end of the third tubular member 15. There may also be an optional cap or upper member 77 (FIG. 14), for example, a rubber or plastic cap to keep rain out of the tubular member interiors or an adapter to provide a small pin or other fitting for securing a grommet of a tarp, net, goal or other component. These two members are optional and therefor separable from the sports pole. The pole is otherwise a unitary structure formed of pieces joined by screws, welding or the like.

As shown at 17, there is an arrangement for locking the third tubular member 15 in the extended position which comprises a U-shaped spring 39 disposed within and near one end of the first tubular member 13 and a pin 41 extendable laterally from the first tubular member through an opening large enough to pass the smaller diameter portion of the pin, but not the larger diameter portion. Thus, the pin 41 and spring 39 are held captive within the member 13 and located near the lower end of the first tubular member. When the members are appropriately positioned, the pin 41 extends, under spring urging, into an opening 42 near an end 43 of the third tubular member 15 to lock the member 15 in the extended position. Of course, a range of possible lengths may be achieved by providing a plurality of such holes 42 in member 15. The end of member 13 which contains the spring 39 and pin 41 is opposite the one end of the first tubular member 13 to which the hinge 21 attaches.

Figures 6, 7, 8, 9, 10:
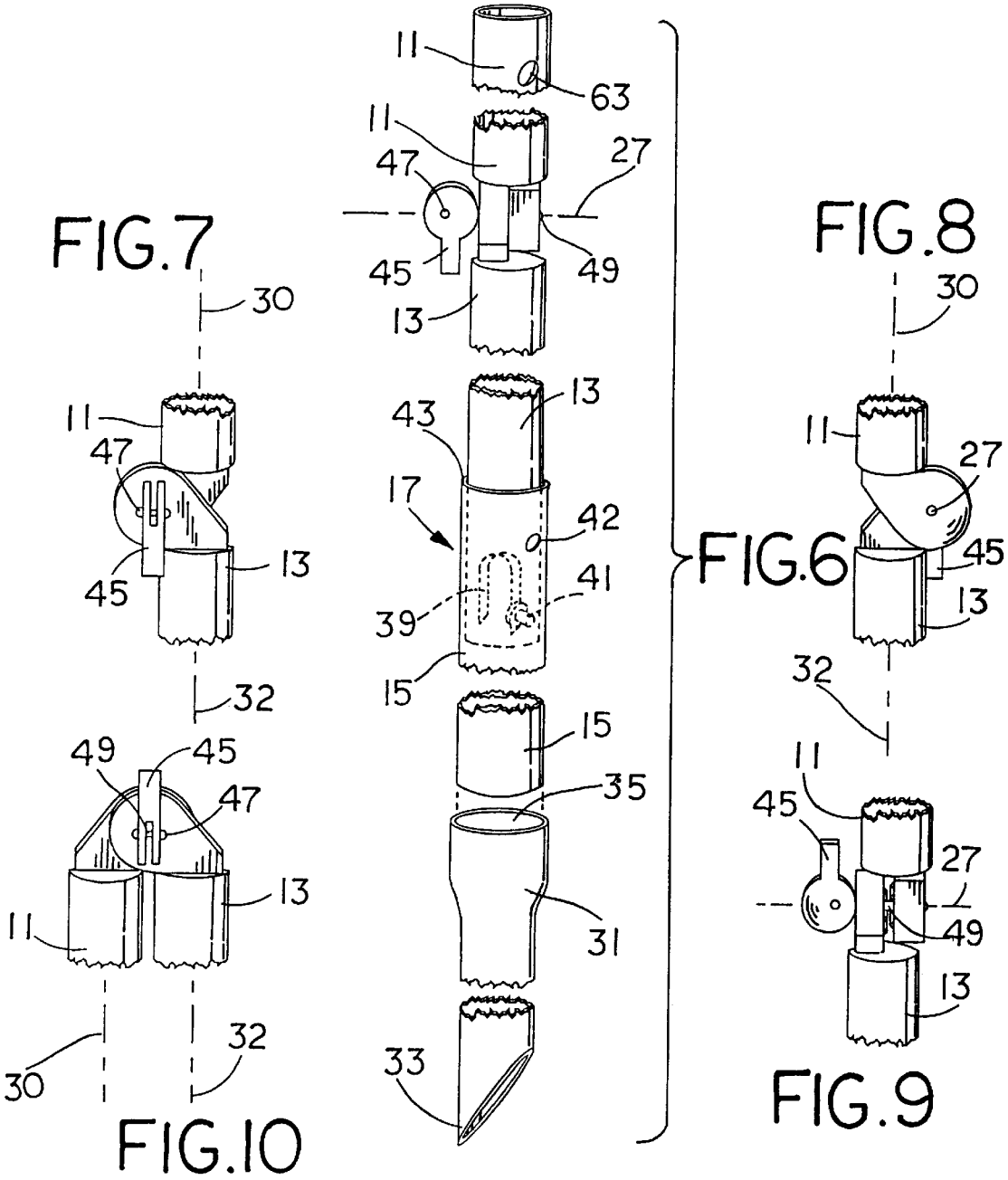
FIG. 6 is a view similar to FIG. 1, but showing an alternate hinging mechanism which may be locked at varying angles besides mutually collinear.
FIG. 7 is a perspective view of the alternate hinging mechanism from the left side of FIG. 6 showing the mechanism locked in the fully extended position.
FIG. 8 is a view similar to FIG. 7, but from the right side of FIG. 6.
FIG. 9 is a perspective view of the alternate hinging mechanism in the unlocked condition.
FIG. 10 is a perspective view similar to FIG. 7, but showing the tubular members in the folded or parallel position.
Figure 12:
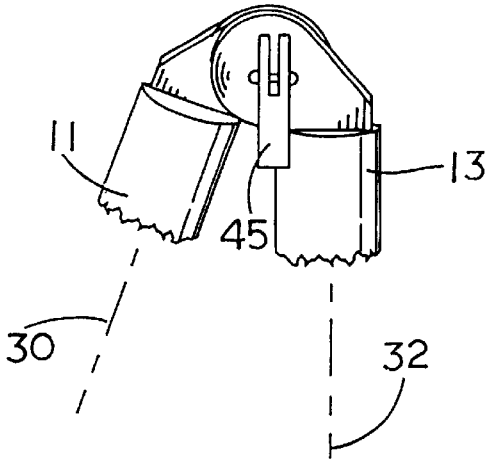
FIG. 12 is a perspective view similar to FIGS. 9 and 10, but showing the alternate hinging mechanism locked with the tubular members obliquely disposed.

A variation on the hinge mechanism 17 of FIG. 1 is shown in FIGS. 6–12. The hinge mechanism locking arrangement includes an eye-bolt 49 which extends coaxial with the hinge pivot axis 27 and which threadedly engages the circular flange of member 11 and passes through a mating circular flange of member 13 terminating where the eye is transversed by pin 47. Pin 47 is located at an eccentric location of cam member 45. The cam 45 when tightened into the position shown in FIGS. 6, 7, 8 and 12 urges the facing surfaces of the circular flanges into engagement while, when loosened as in FIGS. 9 and 10 allows those facing surfaces to separate as best seen in FIG. 9. The facing surfaces may include mating radial teeth and groves or notches 51 for preventing pivotable motion between the first and second tubular members 11 and 13 when the first and second tubular members are in any of several discrete positions between the coaxial (FIGS. 6, 7 and 8) and parallel (FIG. 10) positions. thus, the cam 45 may be locked in a position urging the radially grooved facing surfaces into contact at any of several discrete angular positions, for example, as shown in FIG. 12.

To collapse the pole of FIG. 6, pin 41 is depressed through the hole 42 and pole section 15 telescoped onto pole section 13. The cam 45 is rotated clockwise as viewed freeing the mating surfaces as in FIG. 9 and the pole sections 11 and 13 are pivoted toward one another into the position shown in FIG. 10. The cam 45 may be tightened again to retain the pole sections in this parallel configuration.

Figure 3:
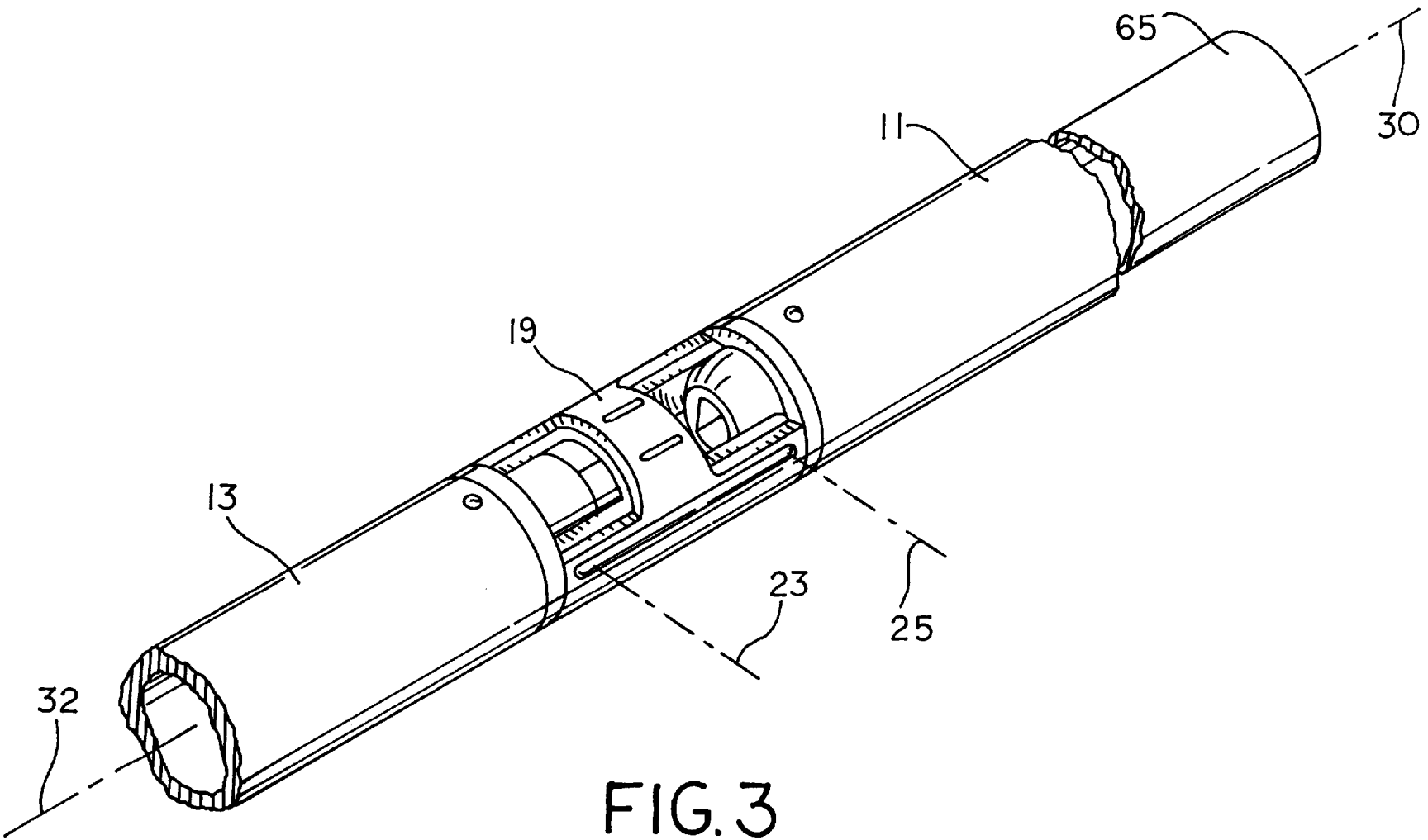
FIG. 3 is a perspective view of the hinge of FIG. 1 an unlocked position.
Figure 4:
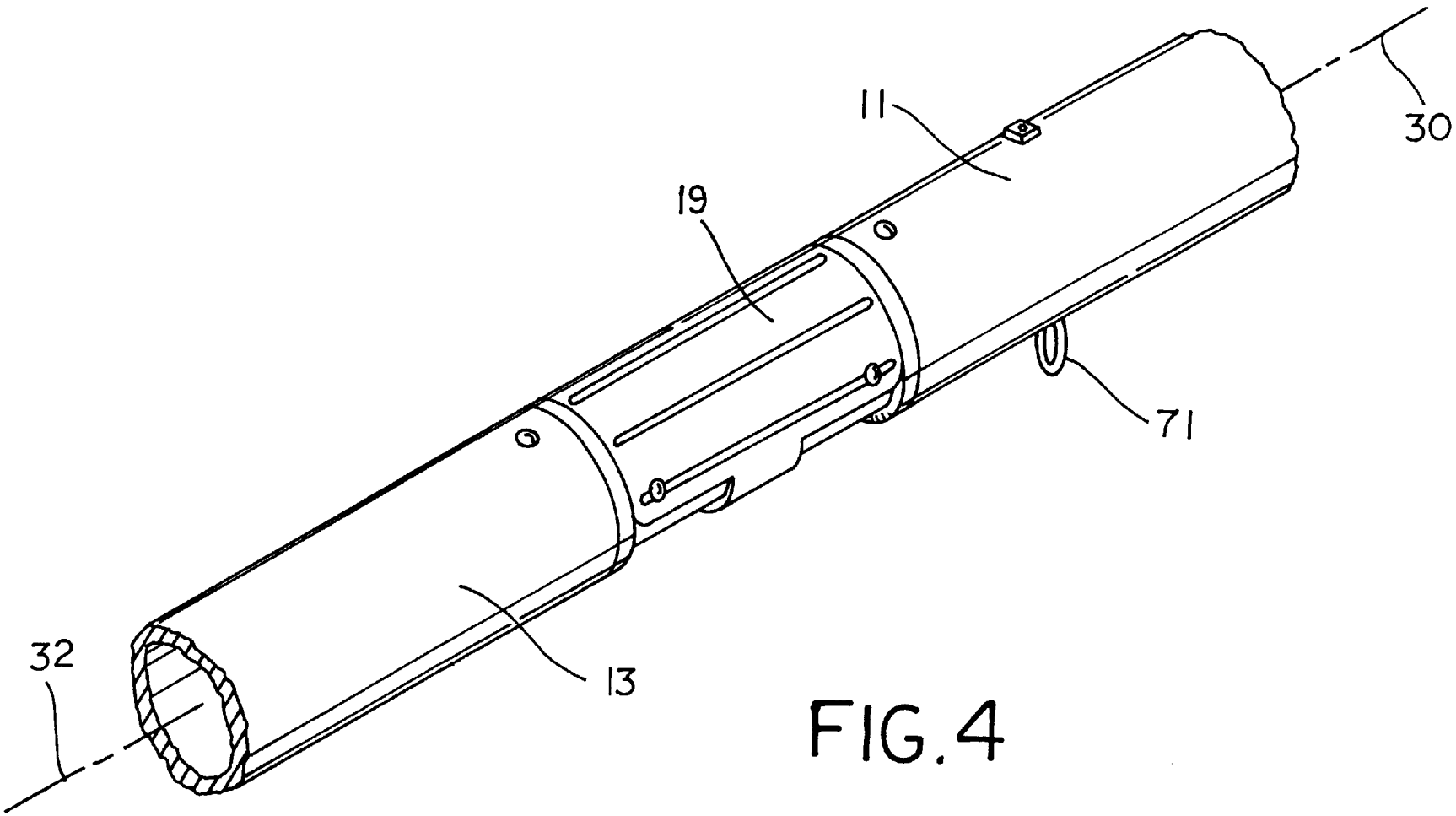
FIG. 4 is a perspective view of the hinge of FIG. 1 locked to maintain tubular members in mutually collinear position.
Figure 13:
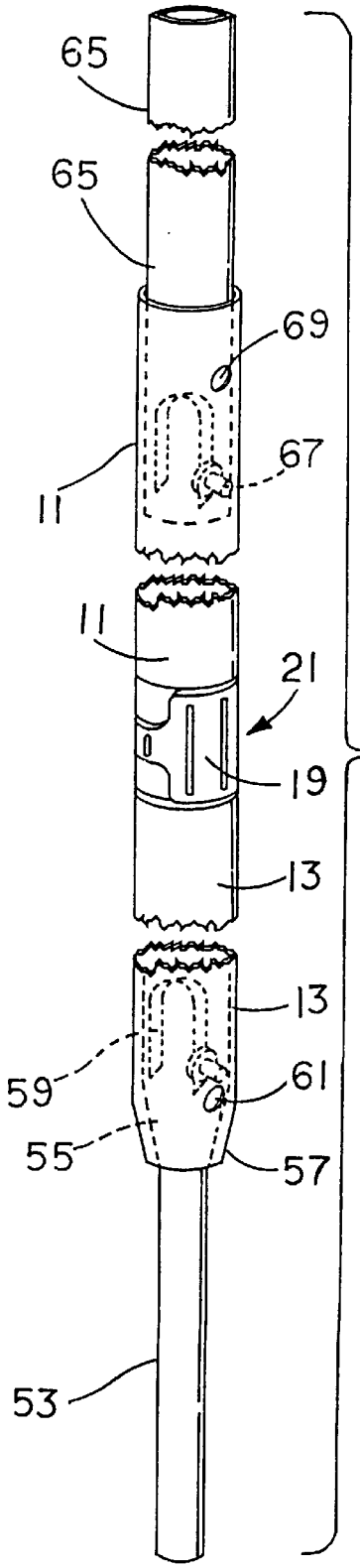
FIG. 13 is a perspective view similar to FIG. 1, but illustrating another modification of the present invention.

FIG. 13 shows some of the many possible variations on the sports pole of the invention. Tubular member 65 is telescopically received within member 11 and the spring and pin 69 move with the member 65. This variation is also illustrated in FIGS. 3 and 5. A fourth tubular member 53 is telescopically received within the member 13 and slidingly movable therein between retracted and extended positions. Tubular member 53 is nearing the limit of its downward travel in the position shown in FIG. 13 and the pin is soon to engage the hole 61. A U-shaped spring 59 and pin arrangement functions like the spring 39 and pin 41 for locking this fourth tubular member in the extended position when the pin passes through opening 61. Tubular member 13 is necked-down at 55 and the tubular member 53 is flared at 55 to prevent separation of members 13 and 53 even though the pin might be depressed through hole 61. Members 11 and 65 may be similarly locked together, thus insuring a unitary structure.

Figure 14:
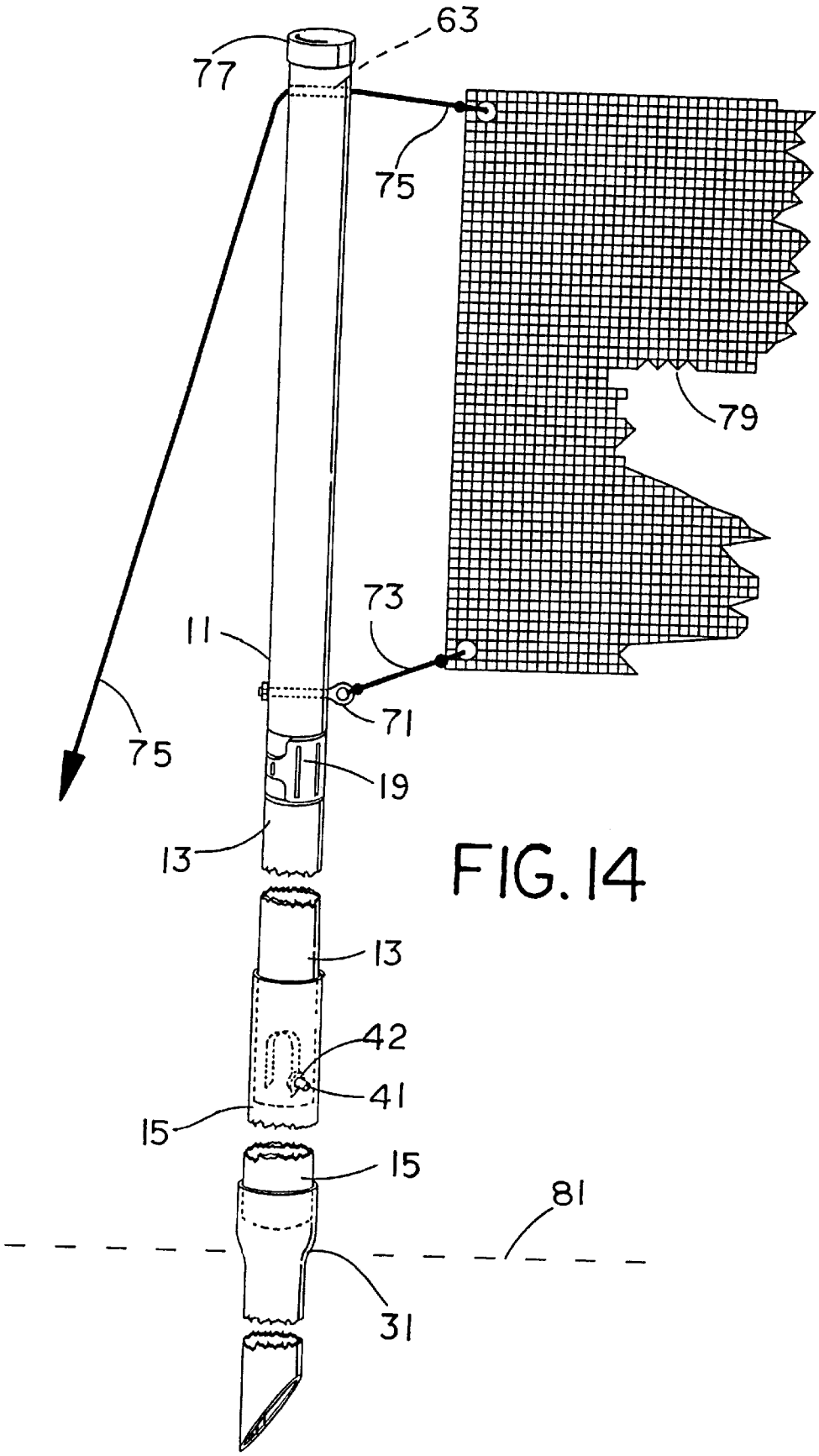
FIG. 14 is a perspective view of the sports pole of FIG. 1 deployed supporting a badminton, volleyball or similar net.

In FIG. 14, the sports pole is illustrated extended and supporting one end of a volleyball or badminton net 79 by line 73 fastened to the eye-bolt 71 located, for example, about two inches above the cuff 19 (also shown in FIG. 4) and line 75 which passes through the transverse opening 63 located, for example, about two inches below the top of the pole (also shown in FIG. 1) and downward to be anchored in the ground 81 some distance removed from the base of the pole. The eye bolt 71 and aperture 63 are spaced from one another along the member 11 a distance sufficient to span the height of the sports net 79. A similar pole arrangement (not shown) may support the opposite end of the net 79. Additional diagonal guy lines may be added if desired. For lower net positions such as used in tennis, the spring 39, pin 41 and member 15 may be omitted resulting in a two piece hinged pole for each net end. With such a two piece hinged pole, the two members are desirably of substantially the same length and diameter.

From the foregoing, it is now apparent that a novel unitary collapsible sports pole arrangement has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. A sports pole comprising:

at least three elongated tubular members permanently joined together, a first of said tubular members being pivotably joined near one end to a second of said tubular members, the first and second tubular members being pivotably joined by a hinge mechanism for selective pivotal motion between generally coaxial and generally parallel positions, the hinge mechanism having a single pivotal axis offset from the common axis of the tubular members when in their coaxial position, a third of said tubular members being telescopically mated with said first tubular member and slidingly movable therein between retracted and extended positions; and means for locking the hinge mechanism to prevent pivotable motion between the first and second tubular members when the first and second tubular members are in the coaxial position.

2. The sports pole of claim 1 further comprising means for locking the third tubular member in the extended position.

3. The sports pole of claim 1 wherein the hinge mechanism means for locking includes means for preventing pivotable motion between the first and second tubular members when the first and second tubular members are in any of several discrete positions between the coaxial and parallel positions.

4. The sports pole of claim 3 wherein the first and second tubular members include facing surfaces and the means for locking includes a cam for urging the facing surfaces into contact at any of several discrete angular positions.

5. The sports pole of claim 1 further comprising a further tubular member having one end generally pointed and another end flared to receive an end of the third tubular member.

6. The sports pole of claim 1 wherein the means for locking the third tubular member in the extended position comprises a spring disposed within and near one end of the second tubular member, and a pin extendable laterally from the second tubular member under spring urging into an opening near an end of the third tubular member.

7. The sports pole of claim 1 further comprising a fourth tubular member telescopically received within the second member and slidingly movable therein between retracted and extended positions.

8. The sports pole of claim 7 further comprising means for locking the third tubular member in the extended position.

9. The sports pole of claim 8 wherein the means for locking the third tubular member in the extended position comprises a U-shaped spring disposed within and near one end of the third tubular member, and a pin extendable laterally from the third tubular member near said one end of said third tubular member under spring urging into an opening near an end of the first tubular member opposite said one end of the first tubular member and the means for locking the fourth tubular member in the extended position comprises another U-shaped spring disposed within and near one end of the fourth tubular member, and a pin extendable laterally from the fourth tubular member near said one end of said fourth tubular member under spring urging into an opening near an end of the second tubular member opposite said one end of the second tubular member.

10. The sports pole of claim 1 wherein the first tubular member is telescopically received within the third tubular member.

11. A sports pole comprising a pair of substantially identical elongated tubular members, a hinge mechanism permanently pivotably joining the tubular members together for selective pivotal motion between generally coaxial and generally parallel positions, and means for locking the hinge mechanism to prevent pivotable motion between the tubular members when the tubular members are in the coaxial position, wherein one said tubular member includes an eye-bolt extending transversely therethrough near the hinge mechanism, and an aperture extending transversely therethrough near an end of the tubular member remote from the hinge mechanism, the eye bolt and aperture spaced from one another along the one member a distance sufficient to span the height of a sports net.

12. The sports pole of claim 11 wherein the hinge mechanism includes a pair of spaced apart generally parallel pivotal axes and the means for locking comprises a sleeve rotatable through about 180 degrees about the common member axes between locked and freed positions.

13. The sports pole of claim 11 further comprising an additional tubular member having one end generally pointed and another end flared to receive a lower end of the other tubular member.

14. The sports pole of claim 11 further comprising a cap fitting over and closing said end of the one tubular member while not obstructing the transverse aperture.

15. The sports pole of claim 11 further including a third tubular member telescopically surrounding the other tubular member and slidable therealong between retracted and extended positions, means for locking the third tubular member in the extended position, and an additional tubular member having one end generally pointed and another end flared to receive a lower end of the third tubular member.

16. The sports pole of claim 11 wherein the single pivotal axis of the hinge mechanism is offset from the common axis of the tubular members when in their coaxial position.

* * * * *